US006550225B1

(12) United States Patent
Cahill et al.

(10) Patent No.: US 6,550,225 B1
(45) Date of Patent: Apr. 22, 2003

(54) METHOD AND APPARATUS FOR OBTAINING INDIVIDUAL WEB SECTIONS FROM A WEB OF SHEET MATERIAL

(75) Inventors: Michael John Cahill, Coventry (GB); David Robert Seaward, Coventry (GB)

(73) Assignee: Molins Plc (GB)

( * ) Notice: Subject to any disclaimer, the term of this patent is extended or adjusted under 35 U.S.C. 154(b) by 0 days.

(21) Appl. No.: 09/308,784

(22) PCT Filed: Nov. 26, 1997

(86) PCT No.: PCT/GB97/03234

§ 371 (c)(1),
(2), (4) Date: Oct. 29, 1999

(87) PCT Pub. No.: WO98/23439

PCT Pub. Date: Jun. 4, 1998

(30) Foreign Application Priority Data

Nov. 26, 1996 (EP) ..... 96308530

(51) Int. Cl.[7] ..... B65B 43/04
(52) U.S. Cl. ..... 53/459; 53/455
(58) Field of Search ..... 53/411, 450, 455, 53/477, 479, 131.4, 131.5, 550, 284.7, 459; 493/186, 189, 194, 199, 200, 201, 202, 205

(56) References Cited

U.S. PATENT DOCUMENTS

| | | | | | |
|---|---|---|---|---|---|
| 2,923,110 | A | * | 2/1960 | Tamarin | 53/133.7 |
| 3,300,944 | A | * | 1/1967 | Thesing | 53/552 |
| 3,586,577 | A | * | 6/1971 | Bella | 156/353 |
| 5,080,643 | A | * | 1/1992 | Mitchell et al. | 493/189 |
| 5,210,993 | A | * | 5/1993 | Van boxtel | 53/455 |
| 5,287,681 | A | * | 2/1994 | Vernon et al. | 53/550 |
| 5,444,964 | A | * | 8/1995 | Hanagata | 53/550 |
| 5,795,280 | A | | 8/1998 | Fowler et al. | |

* cited by examiner

*Primary Examiner*—Scott A. Smith
*Assistant Examiner*—Chukwurah Nathaniel
(74) *Attorney, Agent, or Firm*—Jensen & Puntigam, P.S.

(57) ABSTRACT

A method is disclosed of forming a bag having a bottom seal from a web of sealable sheet material which is formed into a tube (12) by sealing opposite longitudinal edge portions of the sheet material one to another. The method comprises feeding the tube (12) in flattened form further along a feed path to a severing station (10), severing the flattened tube (12) in passage through the severing station (10) into individual flattened bag lengths (36) by passage between a rotary knife (26) and a counter blade (26'), feeding the individual flattened bag lengths (36) longitudinally along the feed path to a sealing station (11), and applying pressure, and possibly also heat, to opposite faces of an end portion of each flattened bag length (36) as it passes through the sealing station (11) by means of blocks (31) for a predetermined time which is longer than the period between severing that bag length (36) from the flattened tube (12) and severing the next bag length (36) from the flattened tube (12) while continuing to feed the flattened bag length (36) longitudinally along the feed path thereby to form a bottom seal (41) for the bag. Preferably the flattened tube (12) is formed with gussets (14, 15). The blocks (31) can be heated if the web is made of a heat sealable material. The heater bars (38, 39) for the gussets (14, 15) can be mounted on a different, more lightly spring loaded, mounting block from that for the heater bar (37) which forms the transverse bottom seal (41). By using rollers (24, 25) and making blocks (31) move slightly faster than the speed of the flattened tube (12) prior to severance of the bag length (36) it can be ensured that the bag lengths (36) are positively severed from the flattened tube (12) despite possible wear of, or damage to, the cutter blades (26, 26'). Registration of the printing on the web (12) so that the blocks (31) contact the web (12) in appropriate position to form the bottom seal (41) can be achieved, when the desired registration is disturbed, by temporarily varying the feed speed of the web (12) with respect to the speed of rotation of the rotary knife (26) so as to vary temporarily the lengths of the bag lengths (36) severed from the tube (12) until the desired registration is re-established.

6 Claims, 2 Drawing Sheets

Figure 1:
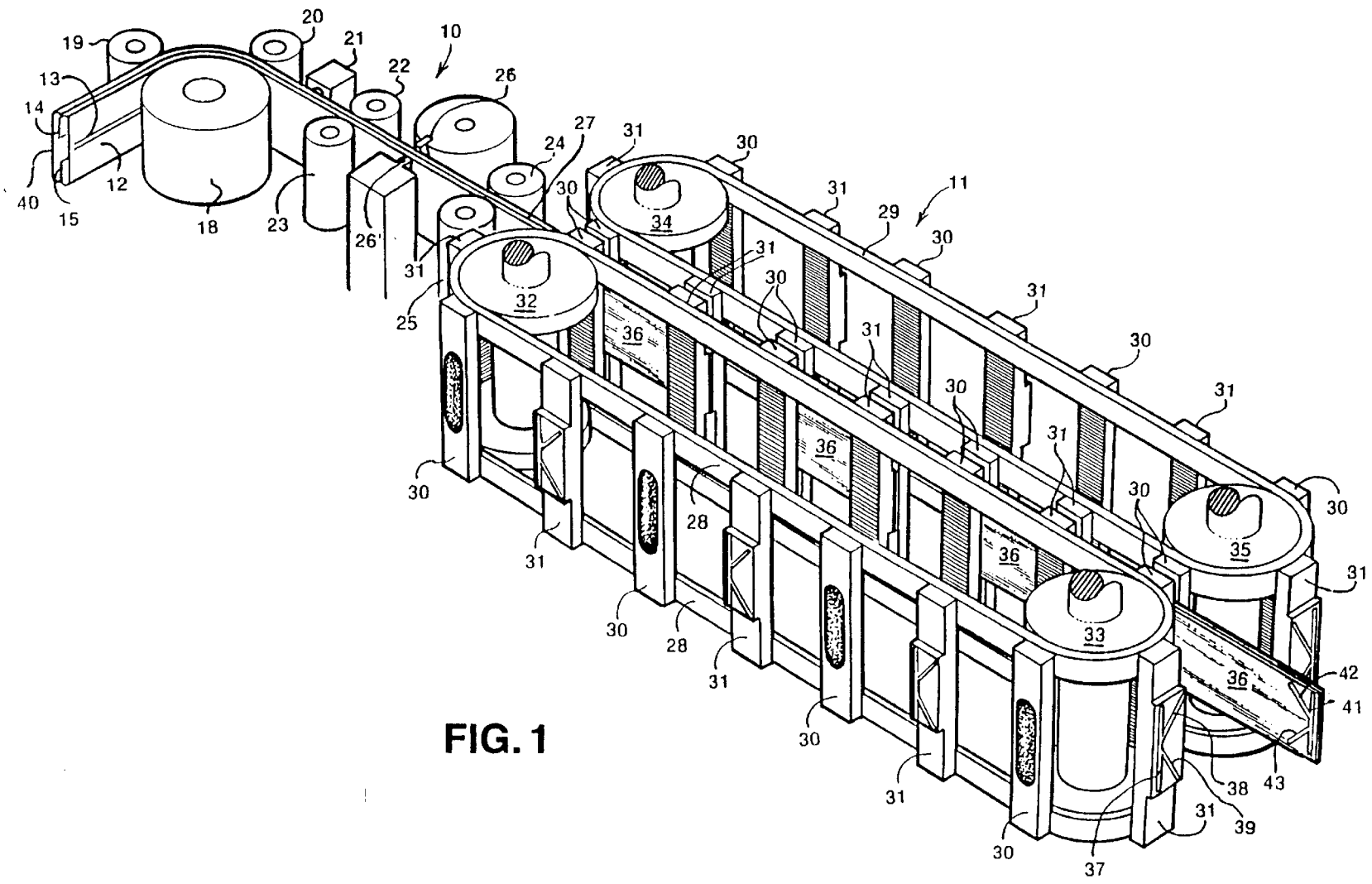

METHOD AND APPARATUS FOR OBTAINING INDIVIDUAL WEB SECTIONS FROM A WEB OF SHEET MATERIAL

This invention relates to a method of, and an apparatus for, obtaining individual web sections from a web of sheet material, for example, to a method of, and apparatus for, forming bags from a length of a sealable sheet material.

In GB-A-1052701 there is described a method of making bags of a thermoplastic synthetic resin film comprising tube-making means including a pair of cooling means disposed between a guide roll and take-up rolls along the advancing direction of the film or films and in the vicinity of the edges at the two sides of the sheet or sheets to be sealed, the cooling means having a gap therein for cooling the films by the slidable movement of the films therethrough, heating means disposed in proximity of the film edges which protrude beyond the cooling means, and another cooling means disposed next following the heating means and on the same side as the heating means relatively of the film edges; a severing means for cutting the thermoplastic synthetic resin film tube whose edges have been completely sealed together by said tube making means, in predetermined lengths at right angles to the advancing direction of the film tube; and a bag bottom sealing means having heating means for fusing together the severed edge of the film tube. This bag bottom sealing means is provided at right angles to the tube-making and severing means; hence a conveying means consisting of an accelerating stacker and a direction-changing stacker is interposed between the tube-making and severing means and the bag bottom sealing means. In this arrangement the bag to be formed travels transversely to its former direction of motion and the bottom seal is formed in the new direction of the bag. This design is, by modern standards, incapable of achieving the high bag formation speeds desired today.

U.S. Pat. No. 4,005,970 teaches an apparatus for continuously producing seals in tube-shaped plastics film material comprising means for supplying the web of material, at least one heating beam travelling along with the web and subsequently returning, means for keeping the web mechanically tension-free at the location where it is warm, means for keeping the heated film layers one against the other up to a pressing station, said pressing station comprising two rollers at least one of which is provided with cooling means, and means for discharging the web. There is no description of what happens upon discharge of the web from the apparatus described, but since the web is to be formed into bags the web is presumably cut into bag lengths downstream from the apparatus described.

In U.S. Pat. No. 4,061,458 there is taught an apparatus for processing a web of material without a standstill. This has a pair of confronting transverse tools between which the web is guided. The tools are mounted on carriers guided in pairs on endless chains to follow a path composed of two parallel straight sections joined at the ends by semi-circular sections, the latter being relatively adjustable.

A bag-making machine is described in EP-B-0333726 in which the bags are defined by lines of perforation and weld lines. The cutting means used to form the perforations and the welding means are described as being separately connectible and disconnectible independently of other means.

U.S. Pat. No. 3,147,168 is concerned with manufacture of bags in the form of a series of connected bag sections open at their upper ends. It describes an apparatus in which registration of the seals between successive printed areas is maintained as the bags are formed. The bags are first sealed and then cut in turn from the web.

A similar principle is illustrated in U.S. Pat. No. 4,061,458.

GB-A-1147466 teaches a machine for making bags with an arcuate bottom using a conventional bag making machine which comprises in combination a mechanism for unwinding a film roll, a mechanism for transversely welding the unwound film at specified intervals in the longitudinal direction of the film, a mechanism for transversely cutting the welded film either in front of or behind the weld line thereby to form bags, and a mechanism for extracting the bags thus formed and collecting them in a specified place.

In modern day packaging there is a demand for machines that are capable of working at ever higher and higher speeds, while still producing packages with reliably formed seals and of neat appearance.

Roast and ground coffee is packaged in some countries in bags at atmospheric pressure so that the coffee more or less loosely fills the bag. However, in some countries the consumer is used to purchasing roast and ground coffee in vacuum packed packages. Such packages conventionally have a parallelepipedal shape, somewhat reminiscent of a brick. It is difficult to produce vacuum packages without unsightly wrinkles in the packaging material.

In order to facilitate the formation of a neat vacuum packed package of coffee, it is often packed in gusseted bags. These are typically formed from a tube of thermoplastic material which is itself made by sealing longitudinal edge portions of a web of thermoplastic sheet material one to another. The tube may then be provided with longitudinal creases so as to form a flattened tube at the lateral edges of which panel portions have been folded inwardly to form gussets. However, to form the bottom seal of a bag with gussets it is necessary to supply heat from a pair of opposed external heating bars through four layers of thermoplastic material, an operation that requires a significant time to perform, since the thermoplastic material is normally a relatively poor conductor of heat and it is at the inside surfaces that the thermoplastic material must be heated to welding temperature in order to form a reliable seal. Thus it may require the heating elements to be kept in contact with the outer faces of the flattened gusseted web for a period of from about 0.3 to about 0.75 seconds and under pressure in order to form a reliable seal, depending upon the thickness and thermal conductivity of the thermoplastic material.

An additional problem is that the web is usually preprinted with repeating patterns, each pattern providing advertising material and product information for each successive bag. Normally the web is printed with repeating registration marks for enabling the machine to be adjusted while it is running so that the bottom seals in the bags are in the correct relationship to the printed pattern and so that the bags are severed from the web with the printed information in the correct place thereon. By providing mechanisms for holding a portion of the web temporarily in a buffer along the path of the web and by arranging that at some point in the cycle of formation of each bag the sealing mechanism is out of contact with the web, then the correct print registration can be achieved by temporarily speeding up or slowing down the web as it passes through and between the various stages of the formation of a bag, so that the repeating printed pattern can be restored to the correct registration with the bottom seals. If the web is continuous, then in a high speed machine, the sealing section for forming the bottom seals of the bags may have to be relatively long, in order that each bag can spend sufficient time in contact with the heated elements and under pressure in order to achieve a reliable bottom seal. Once the bottom seal has been made, then the bags can be severed in turn from the web. However, if the speed of operation of the machine is sufficiently high that the time needed to form a reliable seal is greater than the interval between severing one bag and the next from the web, then in such an arrangement it is necessary to provide more than one set of sealing stations along the path of the bags in order to provide a sufficient sealing period for creating a reliable bottom seal and yet to permit print registration to be achieved. In this case a convenient place to achieve the necessary speed adjustment is in the middle of the bag bottom seal sealing section. However, if the heating elements part company from the outside of the web, the web will cool and further time has to be allowed for the interior of the web to achieve the correct welding temperature, when the web again contacts the downstream heating elements, thereby further lengthening the time required for forming the bottom seal of the bag. In addition it is difficult, even when print registration is satisfactory, to ensure that the second and any succeeding pair of sealing elements contacts exactly the same area of the web that was contacted by the previous pair of sealing elements. During adjustment of print registration the second and any succeeding pair of heated elements will not contact exactly the same area, since the web will have been moved, typically by about 0.25 mm, relative to the second and any succeeding heated elements by the print registration adjustment mechanism. Hence the security of any end seal formed during adjustment of print registration is far from satisfactory.

It would be desirable to provide a high speed method of, and apparatus for, obtaining individual sections from a web of sheet material upon which a predetermined process has been performed. It would further be desirable to provide a bag forming machine in which the sealing section used to form the bottom seals of the bags is relatively short and in which the heating elements are kept in contact with the web at all times as it passes through this sealing section. It would be further desirable to provide a high speed bag making machine in which registration of a print pattern with the bottom seals can readily be achieved without disrupting the sealing step used to form the bottom seals of the bags and hence endangering the security of such seals. In addition it would be especially desirable to provide a machine and method for making gusseted bags at high speed, while maintaining print registration in relation-to the bottom seals as they are formed.

The present invention accordingly seeks to provide a high speed method of, and apparatus for, obtaining individual sections from a web of sheet material upon which a predetermined process has been performed. It further seeks to provide a method of making bags at high speed, for example at a rate of from about 200 to about 300 bags per minute, in which the bottom seals of the bags can be reliably formed. It further seeks to provide such a high speed method of making gusseted bags with reliable bottom seals. Yet again it seeks to provide a method of making bags at high production speeds and with great reliability in which print registration can be readily achieved without prolonging the time required for forming the bottom seals of the bags. In addition it seeks to provide apparatus capable of carrying out such methods.

According to the present invention there is provided a method of obtaining individual web sections from a web of sheet material, each web section having a predetermined process performed upon it, comprising the steps of:

(i) feeding a web of sheet material along a feed path to a severing station, said web carrying a succession of repeating features;

(ii) severing the web at positions related to said features so that individual web sections are obtained, each carrying at least one predetermined feature;

(iii) feeding said individual web sections to a processing station; and (iv) carrying out a predetermined process at said processing station in which a predetermined portion of each web section is maintained in registration with a processing element for a predetermined period thereby to effect said process on the web section.

In step (iv) of the method of the invention the predetermined period can be longer than the period between severing of that individual web section from the web and the severing of the next succeeding individual section from the web.

In such a method the repeating features can be features of shape, pattern or other markings. In the method of the invention the individual web sections are preferably fed longitudinally along the feed path to the processing station. Preferably the severing step is carried out so as to maintain the line of severing of each web section from the web in registration with a selected feature on the next web section to be severed from the web. The selected feature can be a registration mark. Preferably severing of the web into individual web sections is effected by means of a rotary knife mounted for rotation about an axis transverse to the direction of feed of the web cooperating with a counter blade, which may be fixed or may rotate, and maintenance of the predetermined portion in registration with the processing element is achieved by temporarily varying the feed speed of the web with respect to the speed of rotation of the rotary knife, when the desired registration is disturbed, thereby to effect a corresponding temporary variation in the length of the individual web sections until the desired registration is re-established. Preferably the rotary knife and the processing element are driven in synchronism.

The severed web sections are preferably fed to and through the processing station at the same speed as or at a speed greater than the speed of feeding the web to the severing station.

In carrying out the method of the invention the predetermined portion of each web section is desirably maintained in registration with the processing element for said predetermined period while passing along a predetermined portion of the feed path.

The web can be in the form of a tube having a longitudinal seal thereon. Moreover the tube can be formed with longitudinal gussets. It is further preferred for the web to be pre-creased longitudinally along lines corresponding to the lines of the gussets.

The web preferably comprises sealable sheet material having a sealable face, whereby when the web is severed into web sections corresponding to bag lengths the inner faces of the bag lengths comprise said sealable material, and said process comprises forming a bottom seal in an individual bag length by causing adherence of predetermined portions of said inner faces one to another. In this case the web may comprise a cold sealable or pressure sensitive sealable material which can be sealed by application of pressure alone at ambient temperature. However, the web may alternatively comprise a heat sealable material, in which case said processing step may comprise applying heat and pressure to a predetermined portion of the outside of a bag length. The individual bag lengths may be gussseted. If the bag lengths are adapted to be opened up and filled to form a substantially parallelepipedal package, then it is preferred if the web is pre-creased along transverse lines corresponding to at least one edge of the package selected from a top edge and a bottom edge thereof.

In a particularly preferred method according to the invention, the web is a web of sealable sheet material and is severed into bag lengths, and the processing step comprises formation of a bottom seal in each bag length; this method comprises feeding the web along a feed path from a supply thereof, forming the sheet material into a tube by sealing opposite longitudinal edge portions of the sheet material one to another, feeding the tube in flattened form further along the feed path to a severing station, severing the flattened tube in passage through the severing station into individual flattened bag lengths, feeding the individual flattened bag lengths longitudinally along the feed path to a sealing station, and applying pressure to opposite faces of an end portion of each flattened bag length as it passes through the sealing station for a predetermined period, which is longer than the period between severing of that bag length from the flattened tube and severing of the next bag length from the flattened tube, while continuing to feed the flattened bag length longitudinally along the feed path thereby to form a bottom seal for the bag. In such a method the web may comprise a heat sealable material, in which case the predetermined process will include also application of heat, simultaneously with pressure, to opposite faces of the end portion of the bag length as it passes through the sealing station. In such a method the sheet material is preferably fed from the supply along the feed path to the severing station at a first feed rate and the individual bag lengths travel from the severing station to and through the sealing station at a second feed rate that is greater than the first feed rate. The sheet material fed from the supply thereof can be pre-printed with a succession of repeating pattern lengths, each corresponding to a bag to be formed and each including print registration indicium means to facilitate correct registration of the respective pattern length on the bag during its formation.

The sheet material can be formed into a tube by sealing edge portions of the web one to another so as to form on the tube a longitudinal fin seal or a longitudinal lap seal. It is also envisaged that the tube may be provided with longitudinal creases before it is flattened whereby the bag is provided with gussets as the bottom seal of the bag is formed. The flattened tube may comprise first and second outer panels, a pair of first inner panels, and a pair of second inner-panels, the first outer panel being bounded by first longitudinal outer creases each of which separates it from a respective one of the.first inner panels and the second outer panel being bounded by second outer longitudinal creases each of which separates it from a respective one of the second inner panels, and each first inner panel being separated from a respective second inner panel by an inner longitudinal crease. In such cases it is also preferred that the first longitudinal creases are each substantially aligned laterally with a respective corresponding second longitudinal crease in the flattened tube. The longitudinal second creases can further be aligned substantially symmetrically with respect to the lateral edges of the flattened tube.

The sealing station preferably comprises a pair of belts, each belt having a run extending parallel to a part of the feed path and carrying at least one block adapted to cooperate with a corresponding block on the other belt to grasp an end portion of the bag length and to form a bottom end seal for each bag. The web of sealable material may be a heat sealable material, in which case the at least one block is heated. In addition it is further preferred for the at least one block on one belt to be arranged to cooperate with a corresponding block on the other belt to grasp the leading end of the bag length. Each belt preferably carries at least one further block which is arranged to cooperate with a corresponding block on the other belt to grasp the other end of the bag length and to deliver it positively further downstream along the feed path.

The invention further provides an apparatus for obtaining individual web sections from a web of sheet material, each web section having a predetermined process performed upon it, comprising:

(i) means for feeding a web of sheet material along a feed path to a severing station, said web carrying a succession of repeating features;

(ii) means for severing the web at the severing station at positions of said web related to said features so that individual web sections are obtained, each carrying at least one predetermined feature;

(iii) means for feeding said individual web sections to a processing station; and (iv) means for carrying out a predetermined process at said processing station whereby a predetermined portion of each web section is maintained in registration with a processing element for a predetermined period thereby to effect said process on the web section.

Preferably the predetermined period is longer than the period between severing of that individual web section from the web and the severing of the next succeeding individual web section from the web.

A preferred form of apparatus according to the present invention comprises:

means for feeding a flattened tube along a feed path to a severing station, said flattened tube being formed from a web of sealable sheet material by sealing opposite longitudinal edge portions of the web of sheet material one to another;

means for severing the flattened tube at positions of the flattened tube related to features thereon in passage through the severing station into individual flattened bag lengths;

means for feeding the individual flattened bag lengths longitudinally further along the feed path to a sealing station; and means for applying pressure to opposite faces of an end portion of each flattened bag length as it passes through the sealing station for a predetermined time which is longer than the period between severing that bag length from the flattened tube and severing of the next bag length from the flattened tube while continuing to feed the flattened bag length longitudinally along the feed path thereby to form a bottom seal for the bag.

Figure 2:
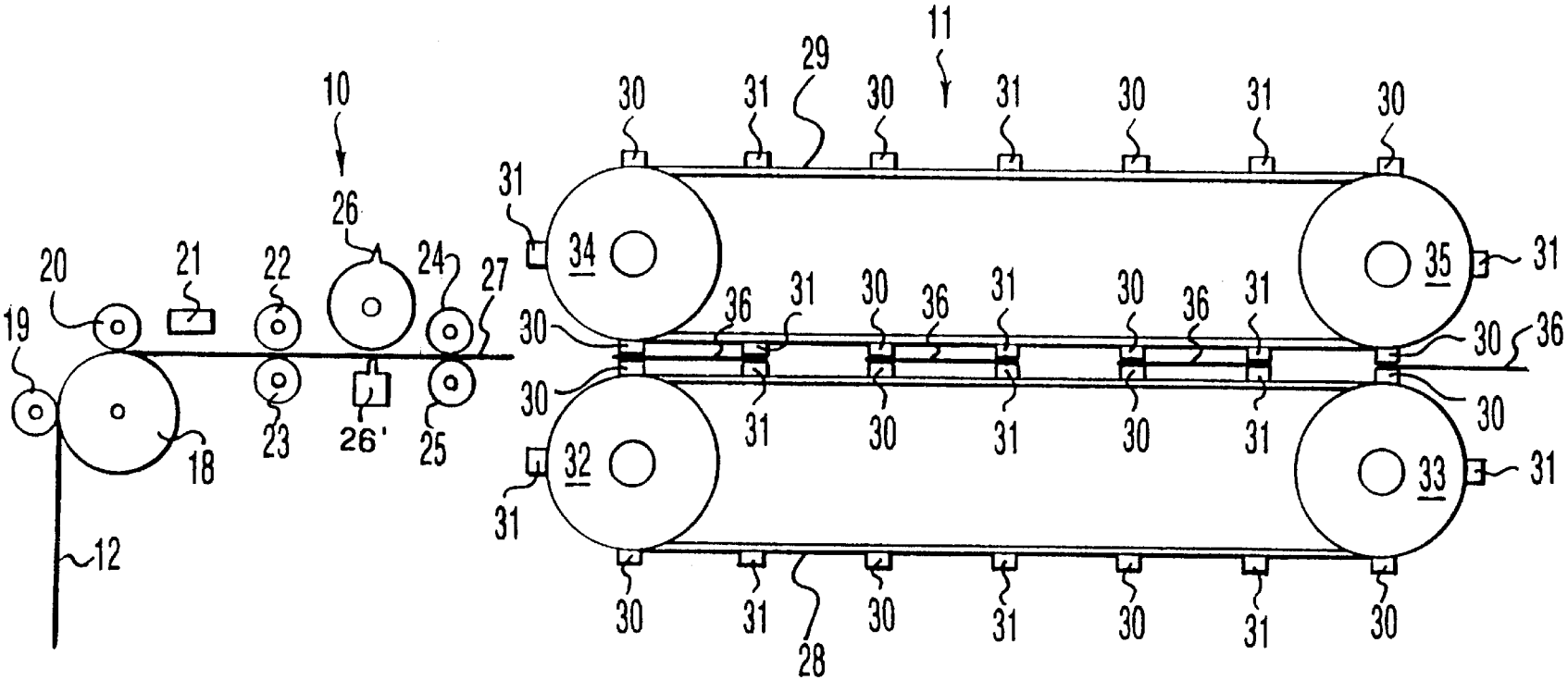

In order that the invention may be clearly understood and readily carried into effect, a preferred method of forming bags and an apparatus suitable therefor, will now be described by way of example only, with reference to the accompanying drawings, wherein:

FIG. 1 is a schematic perspective view of part of the bag forming section of a machine for continuous formation from a length of heat sealable sheet material of bags for subsequent filling, weighing, evacuating, optionally gas flushing, and sealing to form packages; and FIG. 2 is a schematic side view of the bag forming section of FIG. 1.

Referring to FIG. 1, there is shown part of a machine for forming a web into bags for subsequent filling with a predetermined amount of a comminuted material, such as roasted and ground coffee, sealing, and optionally evacuating and/or gas flushing, to form packages. Such packages are desirably in the form of a rectangular parallelepiped. The machine includes a severing station 10 and a sealing station 11 for forming the bottom seals of the bags.

A suitable material from which to make the web is, for example, a laminate of reverse printed polyethylene terephthalate, low density polyethylene, and peelable low density polyethylene. Such a laminate can be, for example, from about 75 μm to about 150 μm, e.g. about 100 μm, thick. It is printed with a repeating pattern (not shown) that repeats at bag length intervals so that each bag will carry the desired advertising material and product information. Normally the pattern will also include print registration indicia to facilitate correct registration of the printed information with the bag lengths as they are formed.

The web is formed in conventional manner into a tube 12 with the peelable low density polyethylene layer on the inside of the tube. For example, the tube 12 can be made by passage through a flowformer (not shown) in which the edges of the web are heated on their inside faces with hot air by means of hot air blowers (not shown) to above the softening point of the peelable low density polyethylene layer and then pressed together by passage through a pair of cold pressure wheels (not shown). In this way the tube 12 is formed with a longitudinal fin seal 13. In addition longitudinal gussets 14, 15 are formed in tube 12 by pulling the tube 12 past gusset formers (not shown). To assist in formation of neat gussets, the web may be pre-creased, upstream from the flow former, along longitudinal lines corresponding to the fold lines of the gussets. In addition the web may be pre-creased along transverse lines corresponding to where the top and/or bottom edges of the eventually formed parallelepipedal package will lie; this is particularly preferred if the package is to be evacuated.

The flattened tube 12 is fed around vertical roller 18; pressure rollers 19, 20 guide tube 12 around roller 18. It then passes print register monitor 21 which detects the position of the print registration indicia (not shown) with respect to the downstream bag severance device to be described hereafter. Drive rollers 22, 23 bear drivingly upon the flattened tube 12 and are responsible for drawing the web off its feed reel (not shown) at a first predetermined speed through any pre-creasing station, through the flowformer and past the longitudinal fin seal forming station and the gusset formers.

Downstream along the path of the flattened tube 12 is a further pair of feed rollers 24, 25 which are arranged to nip sheet material passing between them relatively lightly and to impart to such sheet material a second predetermined speed that is slightly higher than the first predetermined speed for a purpose which will be explained below.

Between the pairs of rollers 22, 23 and 24, 25 is the severing station 10 at which the flattened tube 12 passes between a rotary knife 26 and a stationary blade 26'. Rotary knife 26 is mounted on the periphery of a roller whose axis of rotation is transverse to the direction of feed of the flattened tube 12 so that its cutting edge describes a cylindrical surface. Knife 26 is set so that its cutting edge is at a slight inclination (e.g. about 1° to about 5°) to the axis of the roller on which it is mounted. In this way it shears the flattened tube 12 as it passes the stationary blade 26'. Rotary knife 26 is driven by means of a servo motor so that, as it passes the stationary blade 26', it is moving approximately 20% to 30% faster than the flattened tube 12 past stationary blade 26'. In passing between rotary knife 26 and stationary blade 26' the flattened tube 12 is severed into individual bag lengths of the appropriate length. Rotary knife 26 can be arranged so as to be driven at a uniform speed. Alternatively it can be arranged so that it can be driven at a non-uniform speed during each revolution thereof. Thus between each passage of rotary knife 26 past stationary blade 26' the speed of rotation of rotary knife 26 may remain constant or it may slow and then accelerate again (or it may accelerate and then slow again) in dependence upon the speed of feed of the flattened tube 12 along its feed path and the desired length of bag. The speed of rotation of rotary blade 26 is desirably under computer control.

Desirably the feed speed of the flattened tube 12 and the speed of rotation of rotary blade 26 are chosen so that at least about 150 bag lengths per minute, more preferably at least 200 bag lengths per minute, and even more preferably about 250 up to about 300 bag lengths per minute, are severed from the flattened tube 12.

In FIG. 1 there is shown part of a bag length 27 emerging from the nip between rotary knife 26 and stationary blade 26'. This passes on to the sealing station 11 which comprises a bottom end sealing unit formed by pairs of endless tractor bands 28, 29 carrying alternating holding blocks 30 and end seal blocks 31; tractor bands 28 pass around end rollers 32, 33 and tractor bands 29 pass around end rollers 34, 35. The two pairs of tractor bands 28, 29 are driven in synchronism one with another and with the rotary knife 26. A single servo motor can be provided for driving rollers 18, 19, and 20, drive rollers 20, 21, and feed rollers 24, 25. A second independent servo motor can be provided for driving rotary blade 26 and tractor bands 28, 29; alternatively the same servo motor can be used for driving rotary blade 26 and tractor bands 28, 29 and also for driving rollers 18, 19 and 20, drive rollers 22, 23, and feed rollers 24, 25 and tractor bands 28, 29, with a second servo motor under computer control interposed in the drive mechanism between the drive for rotary blade 26 and tractor bands 28, 29 and the drive for rollers 18, 19 and 20, drive rollers 22, 23, and feed rollers 24, 25.

Blocks 30 on tractor bands 28 are arranged so that each forms a nip with its respective corresponding block 30 on tractor bands 29 at the inlet end of the conveyer system formed by the two pairs of tractor bands 28, 29. Likewise blocks 31 on tractor bands 28 are each arranged to form a nip with the respective corresponding block 31 on tractor bands 29 at the inlet end of the conveyer system formed by the tractor bands 28, 29. The spacing between each block 30 and the preceding block 31 corresponds to the length of a severed bag length 36 so that the blocks 31 can grip the leading end of a severed bag length and form a bottom seal therein while the blocks 30 can grip the trailing end of a severed bag length which corresponds to the top end of the bag. Blocks 30 are unheated and not only provide positive control of the bags as they pass through the bottom end sealing unit but also ensure that each sealed bag is positively discharged therefrom.

When the material of web 1 is a pressure sealable material, then blocks 31 are not heated. However, if the material of web 1 is heat sealable, then each block 31 is formed from copper and is fitted with an internal electric heater (not shown) whose temperature is controlled by a temperature controller (not shown) mounted on the respective block 31. Current is fed to the heaters in blocks 31 via suitable brushgear (not shown) from slip rings (not shown) mounted adjacent the path of blocks 31. The heaters in copper blocks 31 are wound so as to give higher dissipation of heat towards their ends so as to ensure a consistent temperature across the sealing face. Provision is preferably made in the control circuitry for the heaters so as to enable either an open circuit or a short circuit of a single heater cartridge or thermocouple to be detected.

As can be seen from FIG. 1, the heated blocks 31 carry seal bars 37, 38 and 39 which together define a generally K-shaped shape. Heater bar 37 is intended to form a transverse seal to form the bottom of the bag. Since this is gusseted, there are four thicknesses of bag material towards the longitudinal edges of each folded bag length 36 where there are the gussets 14 and 15, but only two thicknesses in the central region 40 of the folded tube 12. This means that the danger points for leakage are where the gussets 14 and 15 adjoin the central region 40. It is accordingly imperative that the pressure exerted upon the bag length 36, the temperature to which the heater bar 37 is heated, and the time for which the heater bar 37 is held in contact with the bag length 36 are sufficient to form a leak-free transverse bottom seal 41. On the other hand, the heater bars 38 and 39 are intended merely to form corresponding diagonal seals 42, 43 whose purpose is to promote formation of a neat package. It is not so important that the these diagonal seals 42 and 43 are absolutely leak-free. In order that the seal bars 37, 38 and 39 shall apply an appropriate pressure to each bag length 36 as it is gripped between a pair of cooperating blocks 31, they are spring loaded. However, heater bars 38 and 39 are mounted on a separate backing plate from that upon which the seal bar 37 is mounted and the spring loading on the backing plate for each seal bar 37 is greater than that on the backing plate upon which seal bars 38 and 39 are mounted. This enables the overall pressure exerted by blocks 31 upon the bag length 36 to be somewhat reduced from the pressure that would obtain if all of the seal bars 37, 38 and 39 were equally loaded.

The distance between rollers 32 and 33 and that between rollers 34 and 35 are so chosen in relation to the maximum design speed of travel of the belts 28, 29 that the period for which heater bars 31 are held in contact with each bag length 36, even at maximum speed of the belts 28, 29, is sufficient to form a leak-free bottom seal 41. For a machine designed to run at up to 300 bag lengths per minute, the period between severance of one bag length from the flattened tube 12 and severance of the next bag length therefrom may be as short as 0.2 seconds. In this case the distance between rollers 32 and 33 and that between rollers 34 and 35 are so chosen in relation to the maximum design speed of belts 28, 29 that a bag length 36 takes at least approximately 0.6 seconds to pass through the bottom end sealing unit. To achieve this end, as can be seen from FIGS. 1 and 2, there are three pairs of heater bars 31, each gripping a bag length 36 between them, along the path of a bag length 36 through the bottom end sealing unit.

As the bags reach the right hand end (as shown in FIGS. 1 and 2) of the belts 28, 29, they continue to be held by the blocks 30 which continue to eject them positively and smoothly so that they can be grasped by a downstream mechanism (not shown) for passing onward to a downstream filling station for filling with a comminuted material, such as roasted and ground coffee, and then to an evacuation station and, optionally, to a gas flushing station.

In operation of the illustrated machine, the web is fed from its feed reel through the tube forming section in which it is formed into tube 12. Then gussets 14 and 15 are formed in the tube 12. Bag lengths 36 are cut off the tube 12 by means of rotary knife 26 acting against stationary blade 26'. The leading end of each bag length 36 is gripped by a pair or heated blocks 31. Since it is arranged that feed rollers 24, 25 have a higher peripheral speed than drive rollers 22, 23 and since belts 28, 29 have a slightly higher linear speed than the speed of tube 12, each bag length 36 is positively torn off the tube 12. In this way the risk of incomplete severance of the bag length 36 by the cutter mechanism formed by rotary knife 26 and stationary blade 26', perhaps due to damage to or wear of the rotary knife 26, is obviated.

If the print registration detector 21 detects from appropriate print registration marks on the flattened tube 12 that the flattened tube 12 is not correctly in registration with the rotation of rotary knife 26 (as, for example, may happen when a new reel of web is loaded), then it sends a signal to the computer which is controlling the passage of the flattened tube 12 through the severing station 10 and the sealing station 11. The computer then speeds up or slows down the rollers 18, 19, and 20, the drive rollers 22, 23, and feed rollers 24, 25, as appropriate, and hence varies the speed of the flattened tube 12 through the severing station 10. The rotary knife 26 and the belts.28, 29 continue to run at the same speed as before. In this way it can be arranged that the next bag length 36 that is to be severed is, or the next few bag lengths 36 that are to be severed are, slightly longer or slightly shorter (for example, about 0.1 mm to about 1 mm, preferably about 0.25 mm, longer or shorter), as the case may be, than the design length of the bag. The pressure exerted by the feed rollers 24, 25 on the flattened tube 12, while sufficient to grip the flattened tube 12 lightly, is sufficiently low to allow slippage of the flattened tube 12 with respect to the feed rollers 24, 25. When the flattened tube 12 is again in the correct registration with the rotary knife 26 and with the blocks 31, the computer returns the speed of rotation of the rollers 18, 19 and 20, the drive rollers 22, 23 and the feed rollers 24, 25 to the appropriate design speed. Since print registration is accomplished upstream of the point of severance of a bag length 36, it is not necessary for the bag length 36 to be released by the blocks 30 or 31 during their passage between belts 28, 29 in order to achieve print registration. This ensures that the heated blocks 31 remain in contact with the flattened tube 12 for the maximum possible time as the bag length 36 passes between the belts 28 and 29, thereby ensuring that the seals 41, 42 and 43 (and particularly the transverse bottom seal 41) are formed in the most efficient possible way.

In the drawings the tube 12 is shown as having a longitudinal fin seal; alternatively tube 12 could be formed with a longitudinal lap seal.

As described above the machine is arranged so that, when it is desired to restore print registration the speed of the flattened tube 12 through the severing station 10 is varied whilst rotary knife 26 and belts 28, 29 continue to run at the same speed as before. Alternatively it is possible, but less preferred, to maintain the feed speed of the flattened tube 12 through the severing station 10 constant and to vary the speed of rotation of rotary knife 26 and the speed of belts 28, 29.

What is claimed is:

1. A method of obtaining and processing individual web sections from a web of sheet material, comprising the steps of:

(i) continuously feeding a web of sheet material along a feed path to a severing station, said web carrying a succession of repeating features;

(ii) severing the web at said severing station at positions related to said features so that individual web sections are obtained, each carrying at least one predetermined feature;

(iii) feeding said individual web sections to and through a processing station at a speed greater than the speed of feeding the web to the severing station; and (iv) moving said individual web sections continuously through the processing station whilst carrying out a predetermined process in which a predetermined portion of each web section is maintained in registration with a processing element for a predetermined period thereby to effect said process on the web section; wherein said processing element is driven in synchronism with said severing the web; and wherein said predetermined period is longer than the period between severing of that individual web section from the web and the severing of the next succeeding individual web section from the web.

2. A method according to claim 1, in which the sheet material is fed from the supply along the feed path to the severing station at a first feed rate and in which the individual bag lengths travel from the severing station to and through the sealing station at a second feed rate that is greater than the first feed rate, and in which the web is a web of sealable sheet material, in which the web is severed into bag lengths, and in which the processing step comprises formation of a bottom seal in each bag length, which method comprises feeding the web along a feed path from a supply thereof, forming the web material into a tube by sealing opposite longitudinal edge portions of the sheet material one to another, feeding the tube in flattened form further along the feed path to a severing station, severing the flattened tube in passage through the severing station into individual flattened bag lengths, feeding the individual flattened bag lengths longitudinally along the feed path to a sealing station, and applying pressure to opposite faces of an end portion of each flattened bag length as it passes through the sealing station for a predetermined period, which is longer than the period between severing of that bag length from the flattened tube and severing of the next bag length from the flattened tube while continuing to feed the flattened bag length longitudinally along the feed path thereby to form a bottom seal for the bag.

3. A method according to claim 1, in which the web is a web of sealable sheet material, in which the web is severed into bag lengths, and in which the processing step comprises formation of a bottom seal in each bag length, which method comprises feeding the web along a feed path from a supply thereof, forming the web material into a tube by sealing opposite longitudinal edge portions of the sheet material one to another, feeding the tube in flattened form further along the feed path to a severing station, severing the flattened tube in passage through the severing station into individual flattened bag lengths, feeding the individual flattened bag lengths longitudinally along the feed path to a sealing station, in which the sealing station comprises a pair of belts, each belt having a run extending parallel to a part of the feed path and carrying at least one block adapted to cooperate with a corresponding block on the other belt to grasp an end portion of the bag length and to form a bottom end seal for each bag and applying pressure to opposite faces of an end portion of each flattened bag length as it passes through the sealing station for a predetermined period, which is longer than the period between severing of that bag length from the flattened tube and severing of the next bag length from the flattened tube while continuing to feed the flattened bag length longitudinally along the feed path thereby to form a bottom seal for the bag.

4. A method according to claim 3, in which the web of sealable material is a heat sealable material and in which the at least one block is heated.

5. A method according to claim 3, in which the at least one block on one belt is arranged to cooperate with a corresponding block on the other belt to grasp the leading end of the bag length.

6. A method according to claim 3, in which each belt carries at least one further block which is arranged to cooperate with a corresponding block on the other belt to grasp the other end of the bag length and to deliver it positively further downstream along the feed path.

* * * * *